US010926896B2

(12) United States Patent
Vetten et al.

(10) Patent No.: US 10,926,896 B2
(45) Date of Patent: Feb. 23, 2021

(54) DEVICE FOR THE SINGLE-SIDED CLOSURE OF PACKAGING SLEEVES FOR THE PRODUCTION OF COMPOSITE PACKAGES

(71) Applicant: SIG Technology AG, Neuhausen am Rheinfall (CH)

(72) Inventors: Thomas Vetten, Duesseldorf (DE); Jürgen Richter, Duesseldorf (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 175 days.

(21) Appl. No.: 16/090,340

(22) PCT Filed: Mar. 16, 2017

(86) PCT No.: PCT/EP2017/056215
§ 371 (c)(1),
(2) Date: Oct. 1, 2018

(87) PCT Pub. No.: WO2017/174321
PCT Pub. Date: Oct. 12, 2017

(65) Prior Publication Data

US 2019/0112090 A1 Apr. 18, 2019

(30) Foreign Application Priority Data

Apr. 4, 2016 (DE) ..... 10 2016 106 139.5
May 31, 2016 (DE) ..... 10 2016 110 008.0

(51) Int. Cl.
*B31B 50/28* (2017.01)
*B31B 50/78* (2017.01)
(Continued)

(52) U.S. Cl.
CPC ..... *B65B 3/025* (2013.01); *B31B 50/006* (2017.08); *B31B 50/28* (2017.08); *B31B 50/322* (2017.08);
(Continued)

(58) Field of Classification Search
CPC ..... B65B 43/08; B65B 43/10; B65B 3/025; B65B 7/16; B65B 41/06; B65B 43/145;
(Continued)

(56) References Cited

U.S. PATENT DOCUMENTS 3,619,979 A * 11/1971 Martensson ..... B65B 3/025 53/565
4,614,079 A * 9/1986 Ida ..... B65B 3/025 53/372.3
(Continued)

FOREIGN PATENT DOCUMENTS

CN 101336193 A 12/2008
CN 103201094 A 7/2013
(Continued)

*Primary Examiner* — Anna K Kinsaul
*Assistant Examiner* — Veronica Martin
(74) *Attorney, Agent, or Firm* — The Webb Law Firm

(57) ABSTRACT

A device is depicted and described for the single-sided closure of packaging sleeves for the production of composite packages, in particular carton/plastic-composite packages, by forming by means of a mandrel wheel with a plurality of mandrels arranged distributed uniformly over the circumference and directed radially outwards, which pass successively through several processing stations in the circumferential direction of the mandrel wheel, wherein each mandrel has a head on its free end, on which the folding sections to be closed of the packaging sleeve slid onto the mandrel are folded and sealed in the closed position, and wherein the head of the mandrel is designed to be variable in its outer dimensions. In order to reliably ensure a reliable and in particular a pocket-free sealing of the end area of the
(Continued)

packaging sleeve on the mandrel, it is provided that at least two corner segments of the head are variable in their position, that the mandrel in its interior has at least one axially movable tappet for the adjustment of the head geometry and that the corner segments of the head are designed as pivot elements, which can be brought from a sealing position into a retracted position.

17 Claims, 8 Drawing Sheets

(51) Int. Cl.

| | |
|---|---|
| ***B31B 50/00*** | (2017.01) |
| ***B31B 50/32*** | (2017.01) |
| ***B65B 3/02*** | (2006.01) |
| ***B65B 43/32*** | (2006.01) |
| ***B65B 43/50*** | (2006.01) |
| ***B65B 7/16*** | (2006.01) |
| ***B65B 61/24*** | (2006.01) |
| ***B65B 43/54*** | (2006.01) |
| ***B65B 41/06*** | (2006.01) |
| ***B65B 43/26*** | (2006.01) |
| ***B65B 43/14*** | (2006.01) |
| ***B65B 55/10*** | (2006.01) |
| *B31B 105/00* | (2017.01) |
| *B31B 100/00* | (2017.01) |

(52) U.S. Cl.
CPC ..... *B31B 50/782* (2017.08); *B31B 50/788* (2017.08); *B65B 7/16* (2013.01); *B65B 41/06* (2013.01); *B65B 43/145* (2013.01); *B65B 43/26* (2013.01); *B65B 43/325* (2013.01); *B65B 43/50* (2013.01); *B65B 43/54* (2013.01); *B65B 55/10* (2013.01); *B65B 61/24* (2013.01); *B31B 2100/0022* (2017.08); *B31B 2105/0022* (2017.08)

(58) Field of Classification Search
CPC ..... B65B 43/26; B65B 43/325; B65B 43/50; B65B 43/54; B65B 55/10; B31B 50/28; B31B 50/30; B31B 50/32; B31B 50/788; B31B 50/006; B31B 50/782; B31B 50/322; B31B 2100/0022; B31B 2105/0022
USPC ..... 493/105, 121, 127, 156, 157, 159, 163, 493/166, 175, 176, 250, 252; 53/563, 53/565
See application file for complete search history.

(56) References Cited

U.S. PATENT DOCUMENTS

| | | | | |
|---|---|---|---|---|
| 4,861,328 | A | 8/1989 | Frank et al. | |
| 5,120,292 | A | 6/1992 | Ueda et al. | |
| 6,412,765 | B1 * | 7/2002 | Blakeley | B21D 51/2646 269/48.1 |
| 8,647,247 | B2 * | 2/2014 | Pazdernik | B31B 50/00 493/175 |
| 2003/0070398 | A1 * | 4/2003 | Morden | B65B 3/025 53/456 |
| 2008/0032878 | A1 * | 2/2008 | Kisch | B31B 50/00 493/174 |
| 2012/0122640 | A1 | 5/2012 | Pazdernik et al. | |
| 2016/0159004 | A1 * | 6/2016 | Poell | B29C 66/1122 229/5.8 |

FOREIGN PATENT DOCUMENTS

| | | | | |
|---|---|---|---|---|
| DE | 1063890 | B | 8/1959 | |
| DE | 8622831 | U1 | 1/1988 | |
| DE | 102013107429 | B3 | 6/2014 | |
| EP | 0249264 | A2 | 12/1987 | |
| EP | 0417864 | A1 | 3/1991 | |
| EP | 0281206 | B1 | 6/1992 | |
| EP | 1817247 | B1 | 5/2008 | |
| EP | 2376331 | B1 | 11/2012 | |
| GB | 2074124 | A | 10/1981 | |
| JP | 1971012938 | Y | 5/1971 | |
| JP | 1975032667 | B | 10/1975 | |
| JP | 1988077733 | A | 4/1988 | |
| JP | 1992031033 | A | 2/1992 | |
| JP | 1993033914 | U | 5/1993 | |
| WO | 9616789 | A1 | 6/1996 | |
| WO | WO-9616789 | A1 * | 6/1996 | B29C 53/42 |
| WO | 2007057829 | A1 | 5/2007 | |

* cited by examiner

DEVICE FOR THE SINGLE-SIDED CLOSURE OF PACKAGING SLEEVES FOR THE PRODUCTION OF COMPOSITE PACKAGES

CROSS REFERENCE TO RELATED APPLICATIONS

This application is the United States national phase of International Application No. PCT/EP2017/056215 filed Mar. 16, 2017, and claims priority to German Patent Application Nos. 10 2016 106 139.5 and 10 2016 110 008.0 filed Apr. 4, 2016, and May 31, 2016, respectively, the disclosures of which are hereby incorporated in their entirety by reference.

BACKGROUND OF THE INVENTION

Field of the Invention

The invention relates to a device for single-sided closure of packaging sleeves for the production of composite packages, in particular, carton/plastic-composite packages, by bottom forming by means of a mandrel wheel with a plurality of mandrels arranged distributed uniformly over the circumference and directed radially outwards, which pass successively through several processing stations in the circumferential direction of the mandrel wheel, wherein each mandrel has a head on its free end, on which the folding sections to be closed of the packaging sleeve slid onto the mandrel are folded and sealed in the closed position, and wherein the head of the mandrel is designed to be variable in its outer dimensions.

Description of Related Art

Devices of the aforementioned type have been known for a long time in the most diverse designs and for the most part are used for closing the bottom of beverage packages to be produced. The folding sections of the packaging sleeve to be closed in the sealing process are thereby pressed firmly onto the underlying mandrel, in order to be able to produce a flat bottom for a good stability of the future package. However, it is also possible to initially carry out the head fold on the mandrel, this is frequently the case, when the future beverage package is also supposed to contain a reclosable pouring element, which is inserted not from the outside, but rather from inside through a corresponding opening in the composite material and sealed there. The application of appropriate pouring elements to a mandrel lends itself to this purpose.

SUMMARY OF THE INVENTION

In FIG. 9 a device is depicted known from the prior art for filling open-top packages C, in particular, with pourable foodstuffs, for the formation of packages P, therefore, a so-called filling machine, comprising a magazine 1 for preparing packaging sleeves S and a device for forming open-top packages C from the packaging sleeves S, which are closed on one side and thus, for example, can receive a pourable foodstuff through the remaining opening. The known filling and sealing device has a row of parallel processing lines, of which only a single process line 2 is depicted in FIG. 9. A magazine 1 with a stack 3 or a bundle of packaging sleeves S folded flatly around two fold lines is assigned to each processing line 2. The packaging sleeves S have been formed from cuts of a packaging material, the longitudinal edges of which are sealed to each other. The packaging sleeves S are unfolded by a feeding device 4. The unfolding of the packaging sleeve S thereby occurs by pulling away a future side surface of the corresponding packaging sleeve S from the stack 3 without further action about the pre-folded fold lines, which form the edges of the packaging sleeve S as well as the future package P. As required, an application device for applying pouring spouts, which are not shown, to the packaging sleeves S could also still be provided.

A known device 5 for the forming and single-sided closure of the packaging sleeves S has a mandrel wheel 6, which comprises six mandrels 7 and is rotated cyclically, therefore step by step counterclockwise. In the first mandrel wheel position I, a packaging sleeve S is slid onto the mandrel 7. Subsequently, the mandrel wheel 6 is further rotated into the next mandrel wheel position II, in which the longitudinal end of the packaging sleeve S protruding relative to the mandrel 7 is heated by means of a heating unit 8 with hot air. In the next mandrel wheel position III, the heated longitudinal end of the packaging sleeve S is pre-folded by the press 9 and tightly closed in the following mandrel wheel position IV in the folded position by a sealing device 10, in particular, sealed to a bottom B. In this manner, a single-sided closed packaging body C, therefore, an open-top package is obtained, which in the following mandrel wheel position V is taken from the mandrel 7 and is transferred to a cell 11 of the endlessly circulated cell chain 12 as a possible conveyor. In the next mandrel wheel position VI, no work step is assigned to the mandrel 7.

The number of mandrel wheel positions or mandrels 7 and the process steps provided there can deviate as required from the depiction according to FIG. 9 and the associated description. In addition, in at least one as required further mandrel wheel position a pouring spout can still be connected with the packaging material. Then the longitudinal end of the packaging sleeve closed on the mandrel wheel is preferably the head of the future package. Whether the packaging body is filled by the future head or by the future bottom plays only a subordinate role in the present case.

The packaging body C taken from the mandrel wheel 6 is transported with the open longitudinal end pointing upwards in a cell 11, in particular, a cell chain, by a filling machine 13. The packaging body C thereby arrives in an aseptic chamber 14, which comprises a sterilisation zone 15 and a filling- and sealing zone 16, through which the packaging bodies C are transported in the transport direction symbolised by the arrows from left to right. The transport of the packaging bodies C does not need to take place linearly, but rather can also take place in at least an arc or even circle lying in a horizontal plane.

The aseptic chamber 14 is fed sterile air via corresponding sterile air connections 17. The packaging bodies C are preheated with hot sterile air by a preheating device 18 successively by blowing with hot sterile air. Subsequently, the packaging bodies C are sterilised by means of a sterilisation device 19, preferably by means of $H_2O_2$ (hydrogen peroxide), whereupon the packaging bodies C are dried by applying sterile air via a drying device 20 and after the passage from the sterilisation zone 15 into the filling- and sealing zone 16 are brought into a filling position underneath a filling outlet 22. There, the packaging bodies C are successively filled with a product 23, in particular with a pourable foodstuff. The filled packaging bodies C are then closed with a closing device 24 by folding the upper area of the packaging body C and sealing. The filled and closed packages P are subsequently removed from the cells 11 of the transport device 12. The now empty cells 11 continue to be moved with the transport device 12 in the direction of the mandrel wheel 6, in order to receive further packaging bodies C there again.

If the packages to be produced are such with quadratic or rectangular cross section, therefore, cuboid packages, the application of a mandrel wheel in a filling machine is unproblematic, since the quadratic or rectangular cross section of the mandrel is adapted to the inner clear cross section of the packaging sleeve to be slid on. It is problematic when the package form deviates from the conventional cuboid form and, for example, has rounded-off or round edges or surface areas, the rounding of which gradually decreases towards the bottom (or gable) and in turn ends in a quadratic or rectangular bottom (or gable). In this connection, the sliding of a corresponding unfolded packaging sleeve onto the mandrel presents problems, since the folding edges of the future package are no longer in accordance with the corners of the head of the mandrel. This can lead to the packages not being quite able to be slid onto the mandrel, so that so-called 'pockets' form when the corner areas are sealed, which can lead to future leaks of the packages.

Another adjustable mandrel is known from WO 96/16789 A1. This document shows all features of the preamble of claim 1 of the present invention.

The object addressed by the invention is to design and to further develop the device for closing packaging sleeves mentioned at the outset and previously described in detail so that a reliable and in particular pocket-free sealing of the end area of a packaging sleeve on the mandrel is reliably ensured.

This object is achieved with a device with the features of the preamble of claim 1 in that at least two corner segments of the head are variable in their position, that the mandrel in its interior has at least one axially movable tappet for the adjustment of the head geometry and that the corner segments of the head are designed as pivot elements, which can be brought from a sealing position into a retracted position.

In this way, it is reliably ensured that the package slid onto the mandrel can be slid on without any problem, since the head of the mandrel is "folded" when being slid on and is only brought into the form necessary for the sealing after being slid on. This is reached with the present invention, wherein at least two corner segments of the head are variable in their position. For this purpose, they can be pivoted from the corners into the interior of the mandrel.

Moreover, in order to adjust the head geometry, the mandrel has in its interior at least one axially movable tappet.

Finally, the corner segments of the head to be moved are designed as pivot elements, which can be brought from a sealing position into a retracted position.

According to a further embodiment of the present invention, the tappet is connected for this purpose with a segment of the head, which is designed as a lifting segment and which is movable through the movement of the tappet into the interior of the mandrel.

Preferably, the pivot segments are designed to be spring-loaded such that they pivot back again into their sealing position after the forcibly actuated pivot into their retracted position. The design of the corner segments as pivot segments is therefore particularly advantageous, since they can be equipped with stable pivot axes, in order to be able to absorb the pressure in the case of pressing during the sealing process.

In a first preferred embodiment of the invention the mandrel has two adjacent corner segments and a lifting segment lying in between. An alternative embodiment provides that the mandrel has four corner segments and two lifting segments lying in each case between two adjacent corner segments. The in each case optimal embodiment of the 'expanding mandrel' according to the present invention will conform as a rule to the actual geometry of the packages to be produced. If it suffices to form only two corner segments of the head of a mandrel to be pivotable, this solution is selected due to the lower constructive expenditure, otherwise, however, it is also possible according to the present invention to design all four corners of the head of the mandrel with adjustable corner segments.

In a further embodiment of the invention it is provided that the force transmission takes place from the tappet to the corner segments by means of a cam gear. Alternatively, it is also possible, however, that the force transmission from the tappet to the corner segments takes place by means of a toggle lever, wherein each corner segment to be pivoted then has a toggle lever of its own.

To achieve the axial movement of the tappet in the interior of the mandrel the invention in a further embodiment provides that the tappet on the mandrel-wheel side is movable by means of a slotted guide arranged in a stationary manner on the outer circumference of the mandrel wheel. For this purpose the slotted guide is preferably arranged on or in a guide sleeve, which is arranged in a rotationally fixed manner on the mandrel wheel or the drive shaft of the mandrel wheel. In this way the rotational movement of the mandrel wheel can be utilised for the adjustment of the tappet, in which the drive of the tappet can be actuated by the—stationary—slotted guide in such a manner that a specific tappet position can be assigned to each mandrel wheel position.

For this purpose, it is provided in a further embodiment of the invention that a guide element is provided with a cam gear for the transmission of the control movement running parallel to the mandrel wheel shaft to the tappet movable radially to the mandrel wheel shaft. Preferably, for this purpose the guide element on the side facing the tappet has a guideway and the tappet on its end on the mandrel wheel side has a roller for rolling on the guideway of the guide element. In this way, through the mechanical coupling of mandrel wheel position and tappet position the head of the mandrel in its slid on position is constantly completely 'folded' and is then upon the further rotation of the mandrel wheel uniformly transferred into its 'unfolded' sealing position, in which all of the pivot elements and lifting segments are in their sealing position.

According to a further preferred embodiment of the invention the tappet is designed adjustable in its length. This is especially advantageous for the fine adjustment and can also still take place in the case of installed mandrels, for example, for maintenance and repair purposes without disassembly of the mandrel.

A further teaching of the invention provides that the mandrel is designed at least partially hollow. In this way, all of the drive parts required for the adjustment of the head segments and their mounting can be well achieved even in the case of a mandrel already mounted on the mandrel wheel shaft.

In a further embodiment of the invention it is provided that the open areas of the mandrel are provided with at least one cover. In this way, the mechanical construction of the tappet drive can be well protected against soiling and penetration by foreign bodies.

So that the packaging sleeve slid onto the mandrel reliably remains in its slid on location even during the rotation of the mandrel, it is provide according to a further embodiment of the invention that the mandrel has at least one spring element acting on its longitudinal side, which fixes the slid on packaging sleeve in its position.

For this purpose it can also be advantageous, if according to a further teaching of the invention the mandrel has lines for cooling water in its solid interior. This is especially advantageous, since in this way an active cooling of the head area of the mandrel can occur, in order to be able to optimally reduce the cycle times. In a water-cooled design the mandrel wheel shaft is designed hollow and the cooling water is conducted through corresponding lines in the interior of the mandrel wheel shaft in a known manner by the individual mandrels.

Finally, a further embodiment of the invention provides that the mandrel has one or several end stops for the mechanical limitation of the sliding path for the packaging sleeve.

BRIEF DESCRIPTION OF THE DRAWINGS

The invention is elucidated in detail below by means of a drawing depicting only preferred embodiments.

In the drawing.

DESCRIPTION OF THE INVENTION

Figure 1:
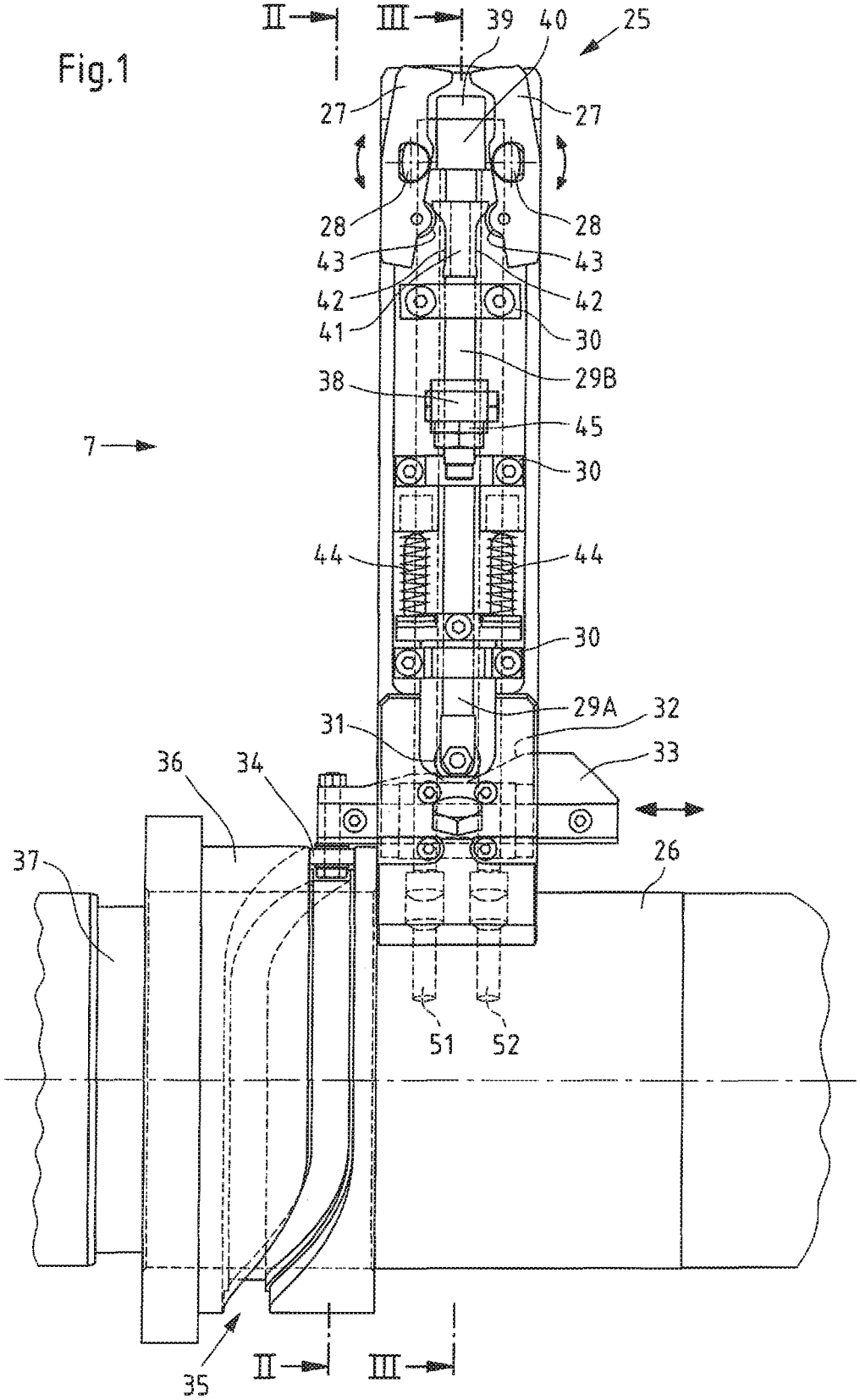
FIG. 1 shows a mandrel of a device according to the present invention in side view in retracted position.

FIG. 1 shows a mandrel 7 according to the present invention with an upturned head 25, wherein the mandrel 7 is fastened on a mandrel wheel shaft 26. In the area of the head 25 pivotable corner segments 27 can be clearly seen, which are not located in their extended sealing position, but rather in their retracted pivot position, in order to make it possible that the sliding of a (not shown) packaging sleeve from above onto the mandrel 7 is facilitated. Two pivot elements having the corner segments 27 are thereby movably mounted with correspondingly stably designed pivot axes 28 on the housing of the mandrel 7. A tappet 29 is used for the actuation of the pivot elements, which tappet is designed in two parts in the depicted and in this respect preferred embodiment and for this purpose comprises a lower tappet 29A and an upper tappet 29B. The tappets 29A and 29B are thereby mounted in an axially displaceable manner by means of bearing blocks 30. At the lower end of the lower tappet 29A a ball bearing 31 is located, the roller of which can be rolled on a guideway 32 of a guide element 33. The guide element 33 is thereby designed in a longitudinally displaceable manner in the direction of the shown double arrow via a corresponding guide parallel to the mandrel wheel shaft 26 and is controlled via a slotted guide. For this purpose, on its left end shown in FIG. 1 the guide element 33 has a ball bearing 34 acting as a sliding block, which ball bearing is guided in a guide groove 35 of a stationary guide sleeve 36. The guide groove 35 is designed in the depicted embodiment such that a pivoting of the mandrel wheel shaft 26 by 180° causes a movement of the guide element 33 from its shown position, in which the pivot elements 27 are folded, into a sealing position, in which the pivot elements 27 are "folded" out. For this purpose, the guide sleeve 36 is designed in a stationary manner; therefore, it does not rotate along with the rotation of the mandrel wheel shaft 26. The mandrel wheel shaft 26 is driven by a drive shaft 37 and can—depending on the number of processing lines in the filling machine—accordingly contain further mandrels 7.

The lower tappet 29A and upper tappet 29B are connected by means of a connection element 38 and ensure that upon actuation of the tappet 29A, 29B upwards a lifting segment 39 is moved axially upwards, in order to close the gap between the two pivotable corner segments 27 on the head surface. For this purpose, the upper tappet 29B is mounted in the area between the pivot elements having the corner segments 27 by means of a bearing 40 designed as a guide sleeve. The pivot movement of the pivot elements having the corner segments 27 thereby occurs by means of a guide element 41, which has cam paths 42 running toward the two pivot elements. The pivot elements themselves in this area have rotatable ball bearings 43, which roll on the cam paths 42 of the guide element 41. It is not discernible, that to realize this cam control the two corner segments 27 are operatively connected with each other by means of a compression spring arranged between them such that the two corner segments 27 can only be moved against the pressure of the spring from their sealing position into the folded position. The compression spring is located for this purpose in the not further specified groove, which is discernible in FIG. 3 on the left next to the lifting segment 39 in the head 25 of the mandrel 7.

Further compression springs 44 ensure that the tappet 29*a*, 29B by means of its ball bearing 31 is constantly in contact with the guideway 32 of the guide element 33.

The upper tappet 29B is designed longitudinally adjustable in the area of its connection element 38 with the lower tappet 29A by means of an adjusting nut 45 for the adjustment of the total length. In this way, a fine adjustment of the upper dead centre of the lifting segment 39 can also be reliably and easily achieved when the mandrel 7 is fully set up.

Figure 2:
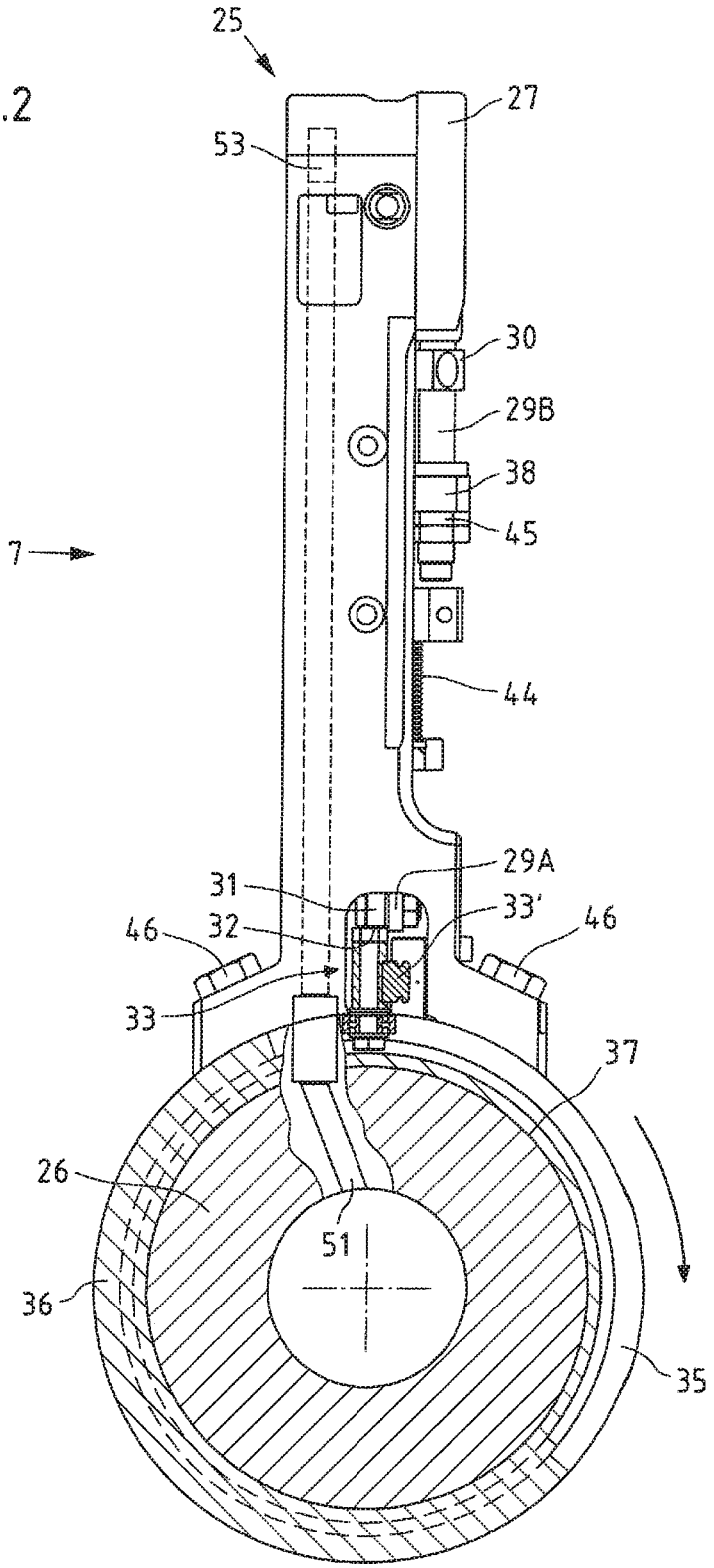
FIG. 2 shows the subject matter from FIG. 1 in a vertical section along the line II-II.

The adjustment of the upper tappet 29B by means of the nut 45 can be learned, in particular, also from the rotated side view in FIG. 2, in which the lower tappet 29B is not visible. The exact design only results from FIG. 3, in which the upper part of the mandrel 7 is also depicted cut along the line III-III in FIG. 1. It can also be learned from FIGS. 2 and 3, that the mandrel 7 is screwed onto the mandrel wheel shaft 26 by means of screws 46. There, the longitudinal displaceability of the guide element 33 by means of a guide rail 33' is also clearly discernible.

Figure 3:
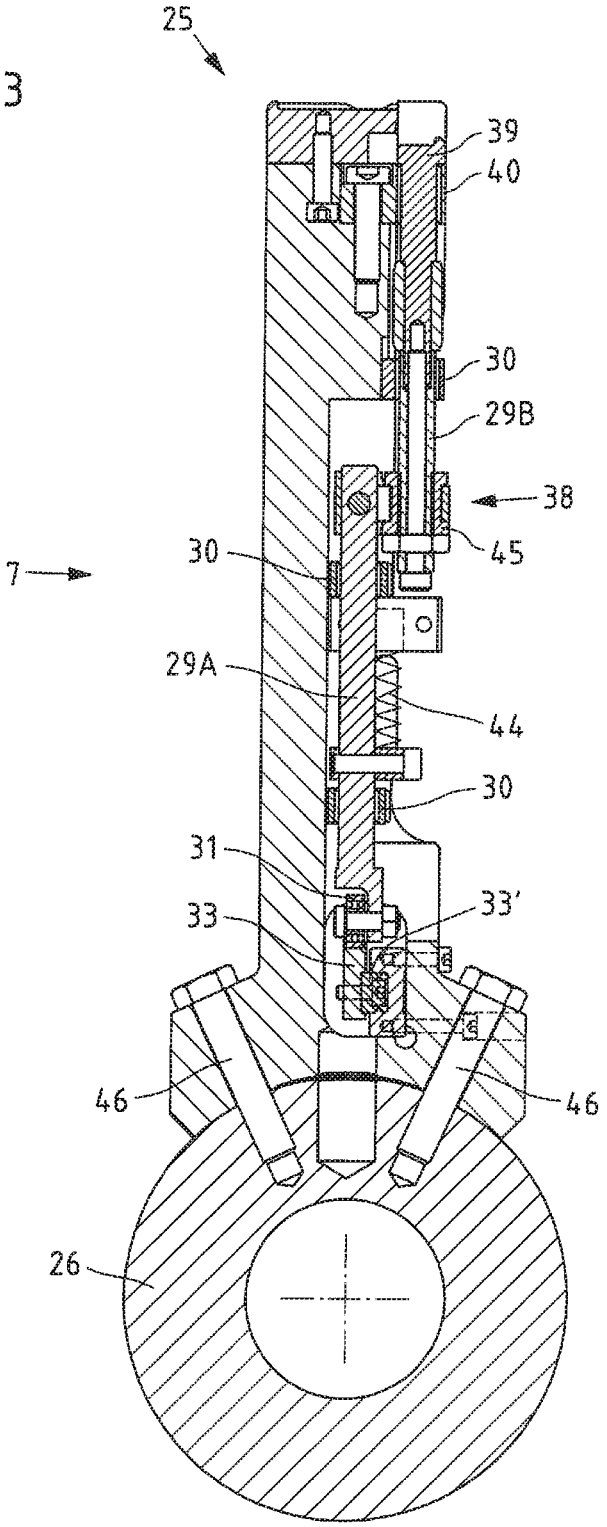
FIG. 3 shows the subject matter from FIG. 1 in a vertical section along line III-III.
Figure 4:
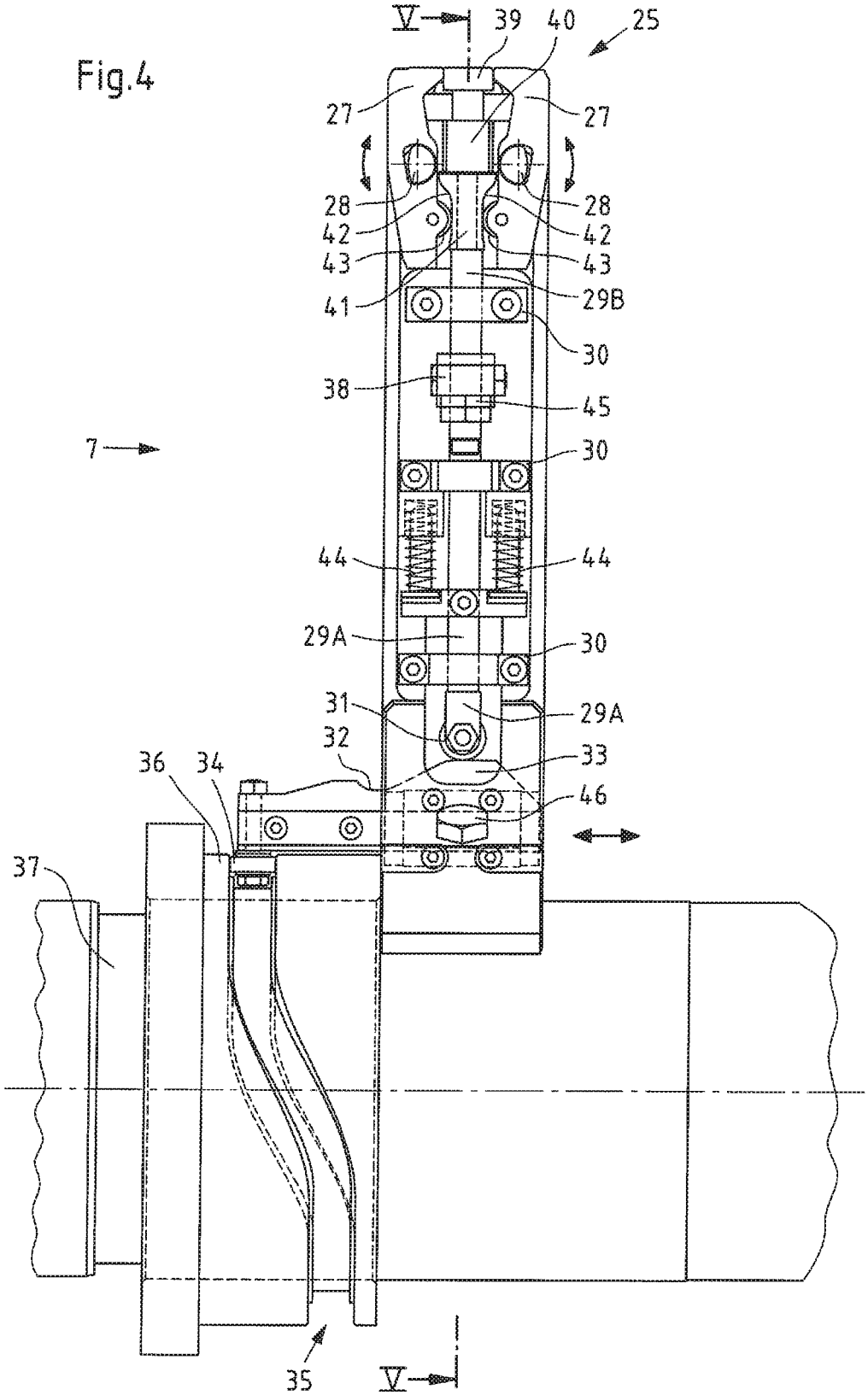
FIG. 4 shows a mandrel of a device according to the present invention in side view in sealing position.
Figure 5:
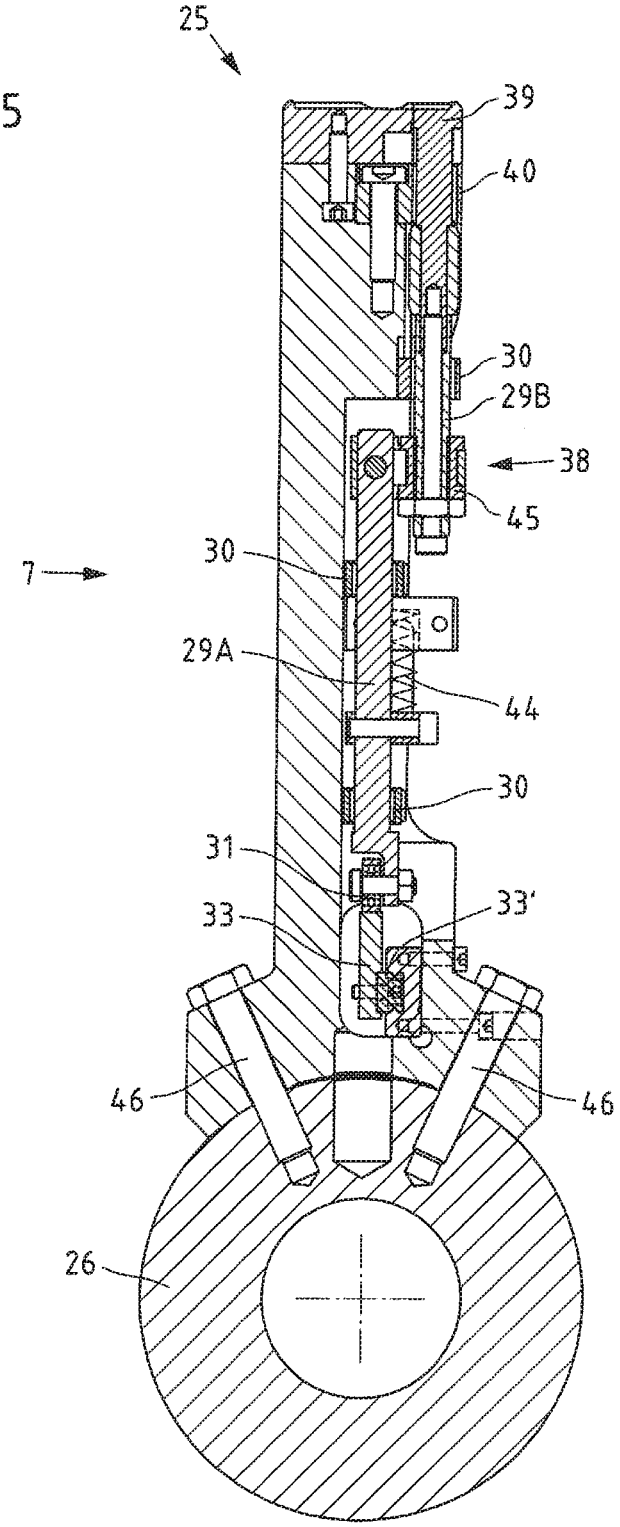
FIG. 5 shows the subject matter from FIG. 4 in a vertical section along the line V-V.

FIGS. 4 and 5 correspond to the representations of FIGS. 1 and 3, wherein, however, here the mandrel 7 is shown in its sealing position. For the sake of better comparability, the mandrel in FIGS. 4 and 5 also points upwards, even though, as already elucidated, in the depicted and in this respect preferred embodiment the sealing position is diametrically opposite the retracted position of the pivot elements, therefore, at downwardly pointing mandrel 7. Accordingly, the actually stationary guide sleeve 36 in FIG. 4 is depicted rotated by 180° in FIG. 4. It is initially recognised, that the guide element 33 is located in its end position by means of the slotted guide 34, 35, so that the lower tappet 29A is shown in its uppermost position. Thus, of course, also the upper tappet 29B is located in its uppermost position and thus also the guide element 41, so that the ball bearings 43 are moved towards each other along the guideway 42 of the guide element 41 and in this way have effected a pivoting of the corner segments 27 of the pivot elements into their outer sealing position. The lifting segment 39 is located finally also in its highest position in the sealing position.

Figure 7:
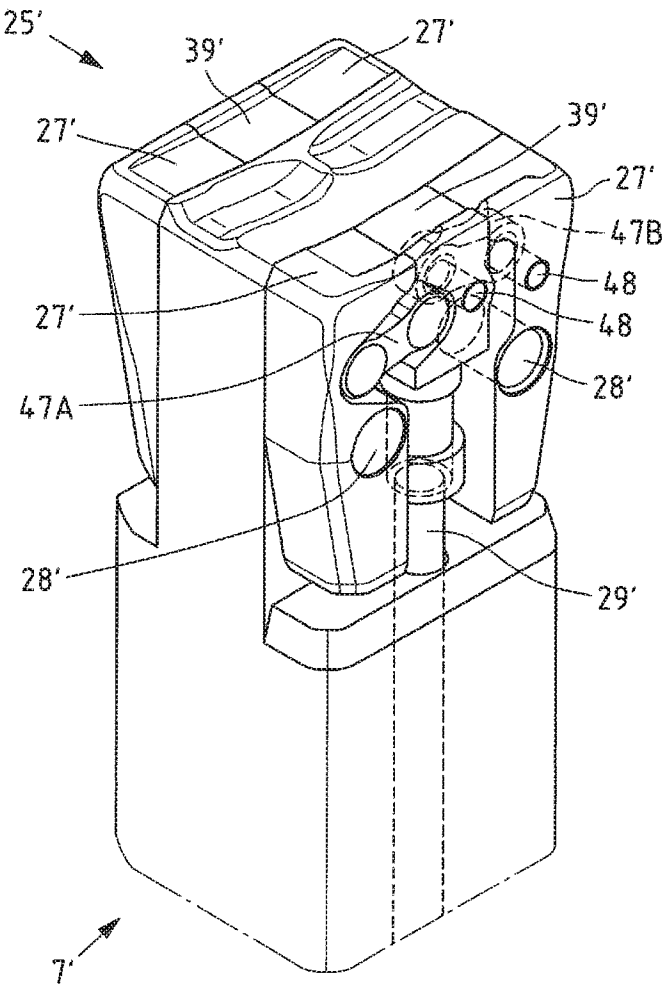
FIG. 7 shows an alternative embodiment of the head of a mandrel according to the present invention with four pivotable corner segments in perspective representation.

This sealing position and configuration of the head 25 of the mandrel 7 is depicted perspectively in FIG. 7 for better representation. It can be clearly discerned, that the entire end surface of the head 25 is now closed and that the two corner segments 27 are now located in their—unfolded—sealing position and the cavity located in between is filled by the lifting element 39. The unspecified cavities on the end surface—in the known manner—serve the purpose of receiving the accumulation of material forming on top of each other when the free lateral surfaces of the slid on packaging sleeve are folded, in particular, in the area of the folded transverse seam, so that when the package bottom, for example, is sealed, a flat surface is generated, which serves as the standing surface of the future package.

Figure 6:
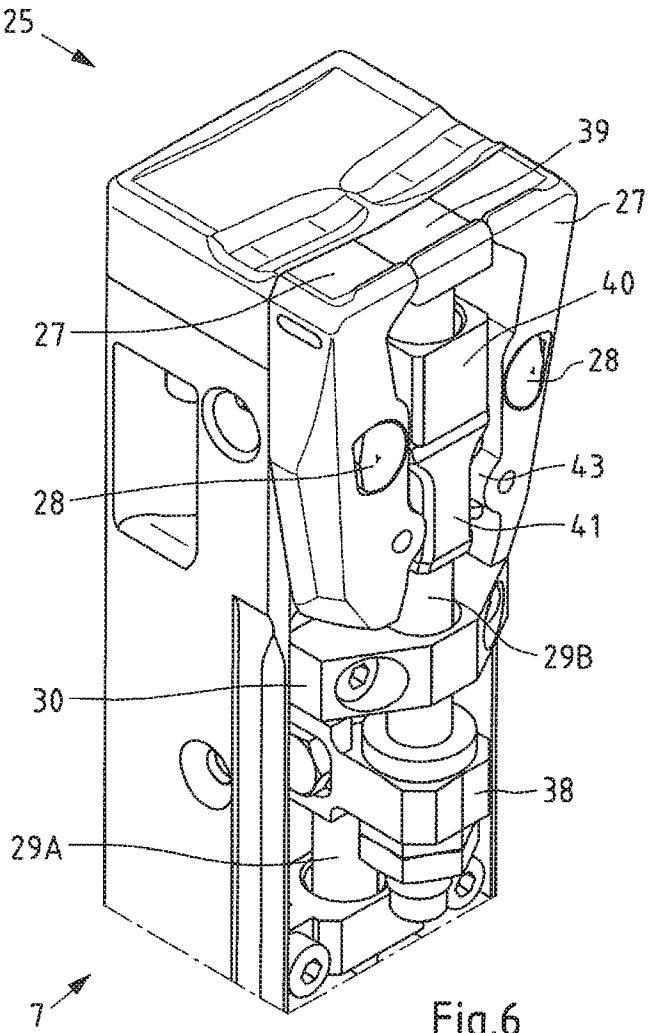
FIG. 6 shows a first embodiment of the head of a mandrel according to the present invention with two pivotable corner segments in perspective representation.

From FIG. 6 it also clearly emerges that the pivot elements having the corner segments are equipped with relatively strongly designed pivot axes 28, in order to be able to withstand the pressure when being pressed.

As already stated, the previously described embodiment is a mandrel 7, which only has two pivotable corner segments 27. However, it is readily possible in a further embodiment also to provide the already described design for the pivoting of the corner segments 27 on the other side of the mandrel. A corresponding design is depicted in FIG. 7. In this alternative mandrel 7', four corner segments 27' are arranged as pivotable segments on corresponding pivot elements, wherein a lifting segment 39' is located between in each case two corner segments 27'.

The drive for the pivoting of the corner segments 27' can thereby be designed, as in FIG. 6, however, it is depicted in FIG. 7, so that the transmission of the force of the tappet 29' to the corner segments 27' can alternatively also occur by means in each case of a toggle lever 47A or 47B, wherein each toggle lever is mounted by means of two axes 48, on the one hand, in the pivot element and, on the other hand, in the lifting segment 39'. The pivot elements are thereby mounted pivotably on the mandrel 7' on corresponding pivot axes 38'.

Figure 8:
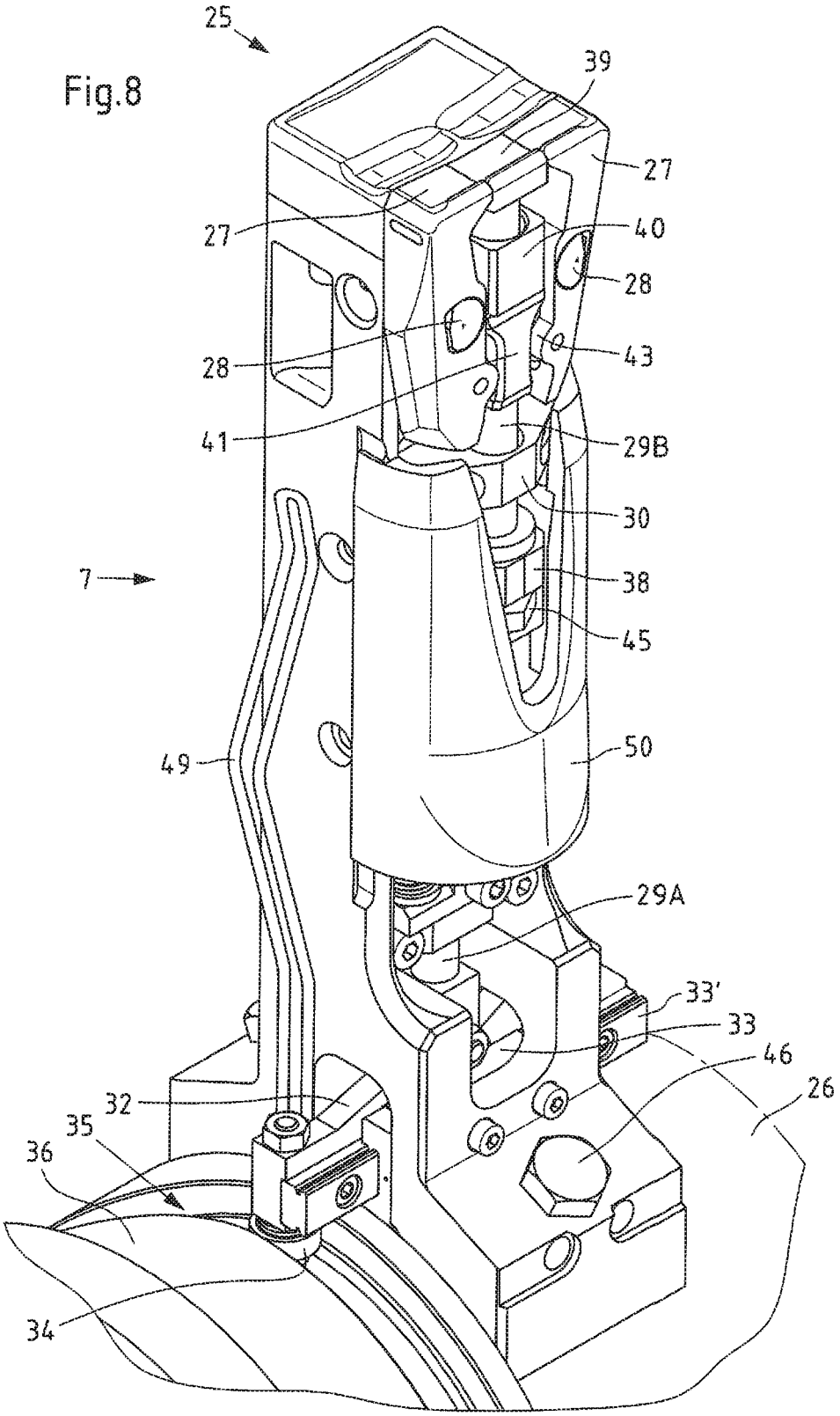
FIG. 8 shows the subject matter from FIG. 4 in perspective representation and FIG. 9 shows a device known from the prior art for filling open-top packages in schematic side view.
Figure 9:
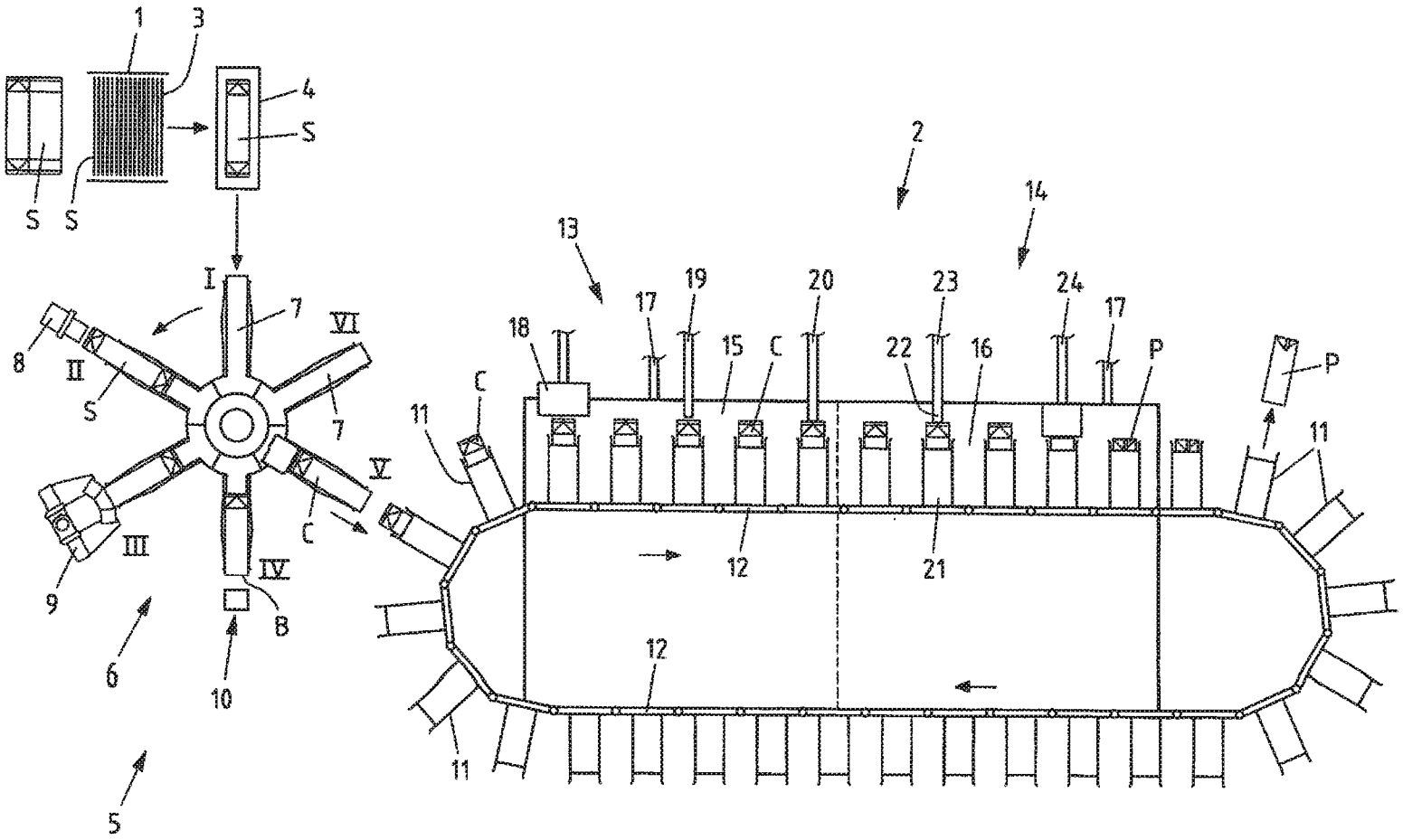
Fig.9 Prior Art

In FIG. 8 it is depicted, that spring elements 49 can be arranged laterally on the mandrel, which spring elements reliably prevent a sliding of a once slid-on packaging sleeve (not shown) onto the mandrel 7. It can also be learned from FIG. 8, that the "open" part of the mandrel 7 is closed by means of a cover 50, the surface of which corresponds to the actual package design and in the embodiment shown has a round side wall and thus protects the inner mechanism of the mandrel 7.

Finally, the mandrel 7 can have lines 51, 52 for conducting cooling water. As emerges from FIGS. 1 and 2, the mandrel wheel shaft 26 in such a case is designed hollow. In the interior of said cavity a distributor element, known per se, is arranged for the cooling water, which is rigidly designed and by means of appropriate circumferential grooves ensures that pressurised cooling water is pressed through the line 51 into the interior of the mandrel and is conducted from the discharge line 52 again into the distributor element. For this purpose, the two lines 51 and 52 are connected with each other in the upper area of the mandrel 7 and/or in the head 25 by means of a connecting groove 53. The distributor element is for this purpose arranged rigidly in the interior of the rotating mandrel wheel shaft and via the corresponding feed and discharge lines ensures that the mandrels 7 can be tempered at the desired stations or over specific distances during the rotation. Thus, a cooling can take place, as it were, "automatically" after the sealing process through the supply of cooling water due to the rotation of the mandrel wheel shaft 26.

The invention claimed is:

1. A device for a single-sided closure of packaging sleeves for a production of composite packages, in particular carton/plastic-composite packages, comprising:

a mandrel wheel, and a plurality of mandrels, wherein the mandrels are arranged uniformly over a circumference of the mandrel wheel and directed radially outwards, passing successively through several processing stations in a circumferential direction of the mandrel wheel, each mandrel has a head on a free end of the mandrel, on which a folding section of a packaging sleeve slides onto the mandrel and are folded and sealed in a closed position, the head of each mandrel is designed to be variable in an outer dimension, and has at least two corner segments that are variable in a position of the head, and an interior of the mandrel comprises at least one axially movable tappet for an adjustment of the head and the corner segments of the head are pivot elements, capable of transitioning between a sealing position and a retracted position.

2. The device according to claim 1, wherein the at least one tappet is connected to a segment of the head, which is designed as a lifting segment and is movable through a movement of the at least one tappet into the interior of the mandrel.

3. The device according to claim 2, wherein the pivot elements are spring-loaded in such a manner that the pivot elements pivot back again into the sealing position after being forcibly actuated into the retracted position.

4. The device according to claim 2, wherein the lifting segment lies between two adjacent corner segments.

5. The device according to claim 2, wherein the mandrel has at least four corner segments and at least two lifting segments lying in each case between two adjacent corner segments.

6. The device according to claim 1, wherein a force transmission takes place from the tappet to the at least two corner segments by means of a cam gear.

7. The device according to claim 1, wherein a force transmission takes place from the tappet to the at least two corner segments by means of a toggle lever.

8. The device of claim 2, wherein the tappet on a mandrel-wheel side is movable by means of a slotted guide arranged in a stationary manner on the outer circumference of the mandrel wheel.

9. The device according to claim 8, wherein the slotted guide is arranged on or in a guide sleeve and the guide sleeve is arranged in a rotationally fixed manner on the mandrel wheel or a drive shaft of the mandrel wheel.

10. The device according to claim 8, wherein a guide element is provided with a cam gear for the transmission of a control movement of the guide element running parallel to a shaft of the mandrel wheel to the tappet movable radially to the shaft of the mandrel wheel.

11. The device according to claim 10, wherein the guide element on a side facing the tappet has a guideway and the tappet has a roller on an end of a mandrel wheel side for rolling on the guideway of the guide element.

12. The device according to claim 1, wherein the length of the tappet is adjustable.

13. The device according to claim 1, wherein the mandrel is at least partially hollow.

14. The device according to claim 13, wherein the mandrel comprises at least one open area with at least one cover.

15. The device according to claim 1, wherein the mandrel comprises at least one spring element acting on a longitudinal side, which fixes the packaging sleeve in the closed position.

16. The device according to claim 1, wherein the mandrel comprises lines for cooling water in a solid interior.

17. The device according to claim 1, wherein the mandrel comprises at least one end stop for a mechanical limitation of a sliding path of the packaging sleeve.

* * * * *